United States Patent [19]

Sonesson

[11] Patent Number: 4,925,428

[45] Date of Patent: May 15, 1990

[54] BALL WITH UNBALANCE MECHANISM

[76] Inventor: Harald V. Sonesson, Stenåldersvägen 131, S-222 54 Lund, Sweden

[21] Appl. No.: 333,035

[22] Filed: Apr. 4, 1989

[51] Int. Cl.[5] ..... A63H 11/08; A63H 17/00; A63B 37/00; A63B 41/00

[52] U.S. Cl. ..... 446/437; 446/324; 273/28; 273/65 EC

[58] Field of Search ..... 446/437, 436, 431, 396, 446/409, 324, 325, 326; 273/28, 58 F, 58 G, 58 H, 65 EC, 128 R, 128 A

[56] References Cited

U.S. PATENT DOCUMENTS

| | | | |
|---|---|---|---|
| 3,106,397 | 10/1963 | Lacey | 446/409 X |
| 3,500,579 | 3/1970 | Bryer | 446/437 X |
| 3,874,663 | 4/1975 | Kahle | 273/58 F X |
| 4,002,893 | 1/1977 | Newcomb et al. | 273/58 G X |
| 4,471,576 | 9/1984 | Martin | 446/437 |

FOREIGN PATENT DOCUMENTS

| | | | |
|---|---|---|---|
| 435782 | 10/1926 | Fed. Rep. of Germany | 446/324 |
| 3433690 | 5/1985 | Fed. Rep. of Germany | 273/58 F |
| 1347961 | 10/1987 | U.S.S.R. | 446/325 |

*Primary Examiner*—Mickey Yu
*Assistant Examiner*—D. Neal Muir
*Attorney, Agent, or Firm*—Laurence R. Brown

[57] ABSTRACT

A toy having a rotational symmetric shape - elliptic or spherical in a section through its axis of symmetry - has an element inside which is movable along the axis of symmetry when the toy is rolling on the ground thereby causing the rolling toy to follow a tortuous path.

5 Claims, 2 Drawing Sheets

BALL WITH UNBALANCE MECHANISM

TECHNICAL FIELD

This invention relates to a toy comprising a rotation symmetrical outer shroud.

BACKGROUND ART

Toys of this type could be suitable for various ball games such as football, golf or other games in which a ball is in rolling contact with the ground. During rolling the point of contact with the ground is generally located vertically below the center of gravity of the ball. In case of a totally rotation symmetrical design the rolling path of the toy will be a straight line on the ground unless the toy has been imparted a spin during a prior throw or kick.

SUMMARY OF THE INVENTION

The present invention relates to a toy which may apparently look like a ball e.g. a football or a golf ball, but which may follow a tortuos path even after being subjected to a straight kick or throw without any spin.

The object of the present invention is to provide a new toy which will follow a surprising path when rolled on the ground and which may be used for completely new types of ball games.

According to the present invention a toy comprising a rotation symmetrical outer shroud has a substantially elliptic periphery in a plane section through an axis of symmetry, said shroud containing a tube mounted coaxially with said axis of symmetry, said tube receiving an axially slidable member the axial length of which is substantially shorter than the length of said tube, resilient displacing means for exerting an axial force in one direction on said member, and loading means for axially moving said member in the direction opposite to the force direction of said displacing means.

A toy according the present invention will have the ability to displace its center of gravity relative its outer shroud when rolled on a surface and thus it may roll along a tortuos path the shape of which may be influenced by selecting the effect of the said loading means.

BRIEF DESCRIPTION OF THE DRAWING

The invention will be described in more detail reference being made to the accompanying drawings in which.

THE PREFERRED EMBODIMENT

Figure 1:
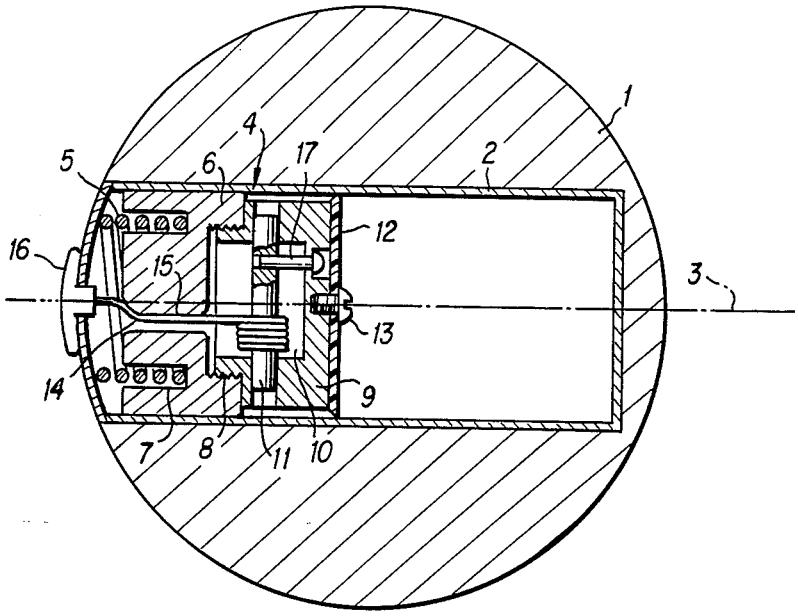
FIG. 1 is a vertical section through a toy according to the invention
Figure 2:
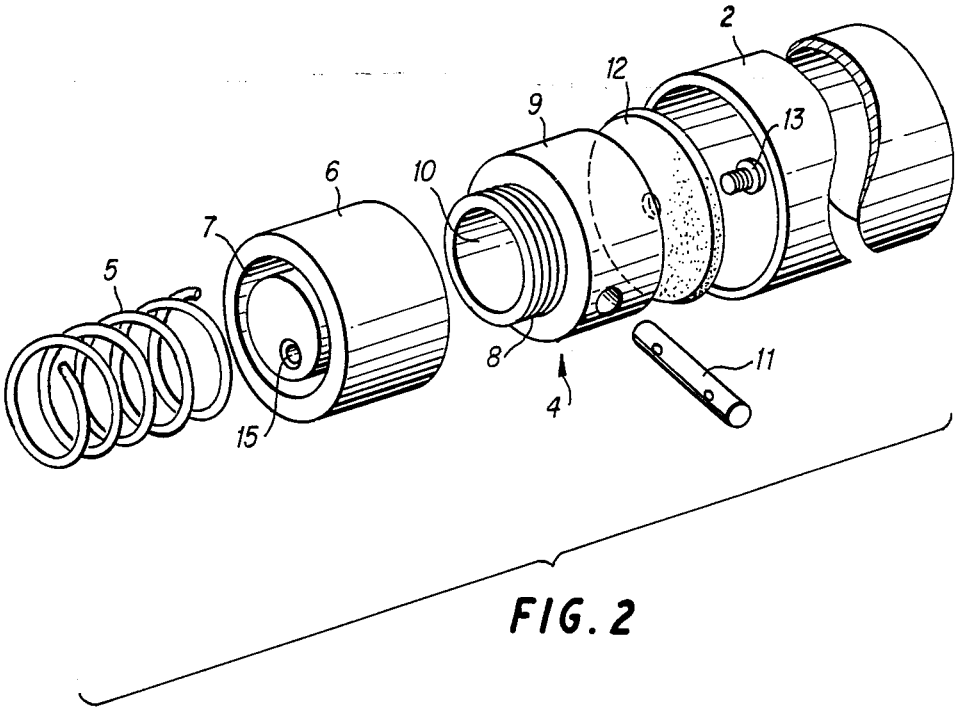
FIG. 2 is an outer view of a slidable member shown in FIG. 1, its components being taken apart.
Figure 3A:
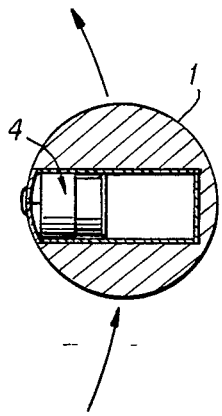
FIG. 3 illustrates the movements performed by a toy according to the invention when rolling on a surface.
Figure 3B:
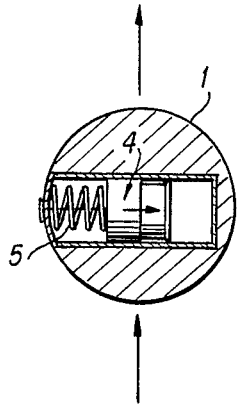
Figure 3C:
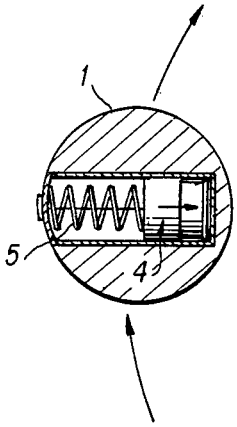
Figure 3D:
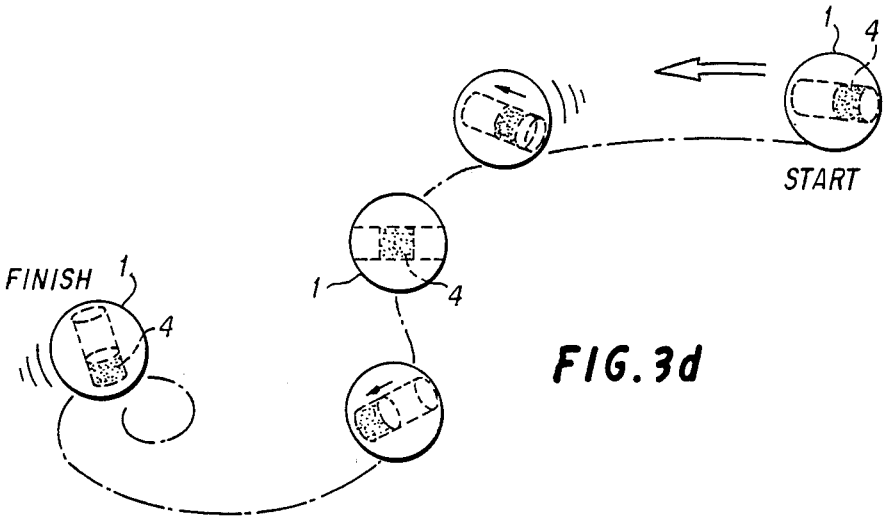

The toy shown in FIGS. 1 and 2 comprises an outer shroud 1 having a circular periphery in the section shown. The shroud 1 contains a tube 2 mounted coaxially with an axis 3 of symmetry of the shroud 1. The tube 2 receives an axially slidable member 4 the axial length of which is less than half the length of the tube 2. A helical spring 5 engages one end the shroud 1 and at its other end the slidable member 4 so as to tend to displace the member towards the right in FIG. 1. The details of the slidable member 4 are shown in more detail in FIG. 2. Said member consists of a solid cylindrical body 6 having an annular recess 7 at one end adapted to partly receive the spring 5. At its other end the body 6 has a threaded bore 8 adapted to receive a correspondingly threaded plug 9. The plug 9 has a bore 10 containing a transversely mounted rotatable pin 11. At its extreme right end the plug 9 carries a seal disc 12 fsatened to the plug 9 by a screw 13. FIG. 2 also shows the tube 2 in which the member 4 is adapted to slide with contact between the disc 12 and the inner surface of the tube 2. As shown in FIG. 1 a line 14 is fastened to the pin 11, wound around said pin and passed through a bore 15 in the body 6. The line 14 is finally passed through a hole in the shroud 1 and fastened to an outer handle 16. Also wound around the pin 11 is a spiral steel spring 17 fastened at one end to the pin 11 and at the other end to the plug 9.

The toy shown in FIGS. 1 and 2 will operate as follows:

In the position shown in FIG. 1 the spring 5 will tend to displace the member 4—primarily the body 6—towards the right in FIG. 1. The movement will be damped by the seal 12 contacting the inner surface of the tube 2. The air contained in the tube 2 to the right of the seal 9 may escape slowly by means not shown—e.g. simply by insufficient sealing around the seal 12. During the displacement of the member 4 the line 14 will cause the pin 11 to to rotate and load the spring 17. The movement of the member 4 may continue until the seal 12 engages the inner surface of the shroud 1 at the right end of the tube 2.

By pulling the handle 16 the member 4 may be returned to its left position within the tube 2 while compressing the spring 5. By releasing the handle 16 the spring 17 will cause the pin 11 to rotate and to wind up the line 14. The loading of the spring 5 should be performed immediately prior to throwing the toy for rolling on the ground.

FIG. 3 illustrates the function of the toy after it has been thrown for rolling on the ground. It is presumed that the throwing is performed with the handle 16 at the left side of the toy.

Initially—when the member 4 is at the left end of the tube 2 a forward throw will cause the toy to roll to the left—position (a) in FIG. 3. After a while the spring 5 will have displaced the member 4 to a position in the middle of the tube 2 (position (b) in FIG. 3). The toy will now continue in a straight forward path. As the member 4 is displaced further towards the right in the tube 2 the toy will finally continue rolling while turning right—see position (c) in FIG. 3.

FIG. 3(*d*) shows the tortuous path followed by the toy.

It will be understood that several modifications of the device illustrated and described above could be made without deviating from the scope of the invention. Thus the damping means provided by interaction between the seal 12 and the tube 2 could be replaced by any known type of dampers. Also the wind up mechanism provided by the pin 11 and the spring 17 could be replaced by other known types of winding devices. The shape and the size of the shroud 1 could be chosen rather freely. E.g. the shape could be elliptic like that of a football or the size could be small as a golf ball. The toy could be combined with a variety of elements not forming parts of the invention—e.g. devices for marking a predetermined tortuous path on the ground to be followed by the toy.

I claim:

1. A toy comprising a rotation symmetrical outer shroud having a substantially elliptic periphery in a plane section through an axis of symmetry, said shroud containing a tube mounted coaxially with said axis of symmetry, said tube receiving an axially slidable member the axial length of which is substantially shorter than the length of said tube, resilient displacing means for exerting an axial force in one direction on said member, loading means for axially moving said member in the direction opposite to the force direction of said displacing means, and means for resisting axial movements of said member, in which said loading means comprises a handle outside said shroud, a line connected to said handle and passed through an opening in said shroud, a pin rotatably mounted in said slidable member perpendicular to the axis of the tube and connected to said line, and means for resiliently actuating said pin for rotation in one direction.

2. A toy as claimed in claim 1 comprising means for resisting axial movements of said member.

3. A toy as claimed in claim 1 in which said displacing means is a helical spring.

4. A toy as claimed in claim 1 in which said means for resiliently actuating said pin for rotation is a spiral spring.

5. A toy comprising a rotation symmetrical outer shroud having a substantially elliptic periphery in a plane section through an axis of symmetry, said shroud containing a tube mounted coaxially with said axis of symmetry, said tube receiving an axially slidable member the axial length of which is substantially shorter than the length of said tube, resilient displacing means for exerting an axial force in one direction on said member, loading means for axially moving said member in the direction opposite to the force direction of said displacing means, and means for resisting axial movements of said member, in which said means resisting axial movements of said member is a sliding seal engaging the inner surface of said tube.

* * * * *